United States Patent [19]

Hoyme

[11] Patent Number: 4,711,626

[45] Date of Patent: Dec. 8, 1987

[54] DAMPER MOUNTING ASSEMBLY

[76] Inventor: Clifford L. Hoyme, P.O. Box 1485, Camrose, Alberta, Canada, T4V 1X3

[21] Appl. No.: 746,187

[22] Filed: Jun. 18, 1985

Related U.S. Application Data

[63] Continuation-in-part of Ser. No. 506,882, Jun. 21, 1983, Pat. No. 4,538,980, which is a continuation-in-part of Ser. No. 225,729, Jan. 15, 1981, Pat. No. 4,426,993.

[51] Int. Cl.[4] ..... F24C 3/00

[52] U.S. Cl. ..... 431/20; 236/1 G; 126/285 R

[58] Field of Search ..... 236/1 G; 431/20; 98/119; 126/285 B, 285 R, 289, 292, 85 B, 290, 312

[56] References Cited

U.S. PATENT DOCUMENTS

| | | | |
|---|---|---|---|
| 1,809,575 | 6/1931 | Sturgis | 126/285 B |
| 1,854,289 | 4/1932 | Barker | 126/285 B |
| 1,921,667 | 8/1933 | Gaston | 126/285 B |
| 2,067,426 | 1/1937 | Stuart | 236/1 G |
| 2,212,298 | 8/1940 | Martin et al. | 126/285 R |
| 2,750,936 | 6/1956 | Saito | 236/1 G |
| 3,171,343 | 3/1965 | Wexler | 98/119 |
| 3,773,028 | 11/1973 | Schreibeis | 126/285 B |
| 3,951,130 | 4/1976 | Lowe | 126/285 B |
| 4,138,060 | 2/1979 | Iacono | 236/1 G |
| 4,151,789 | 5/1979 | Grobard | 98/119 |
| 4,210,277 | 7/1980 | Kolt | 236/49 |
| 4,225,080 | 9/1980 | Barth | 236/1 G |
| 4,254,759 | 3/1981 | Schmidt | 126/285 B |
| 4,426,993 | 1/1984 | Hoyme | 431/20 |
| 4,439,139 | 3/1984 | Nelson et al. | 431/20 |
| 4,538,980 | 9/1985 | Hoyme | 431/20 |
| 4,557,185 | 12/1985 | Harriman | 126/285 B |

FOREIGN PATENT DOCUMENTS

| | | | |
|---|---|---|---|
| 2752422 | 5/1979 | Fed. Rep. of Germany | 126/292 |
| 983142 | 2/1951 | France | 126/285 |
| 1196113 | 6/1970 | United Kingdom | 126/292 |

*Primary Examiner*—Samuel Scott
*Assistant Examiner*—H. A. Odar
*Attorney, Agent, or Firm*—Fleit, Jacobson, Cohn & Price

[57] ABSTRACT

A housing supporting a signal-controlled, power operating unit for a damper is mounted internally within a duct by a tubular supporting sleeve in an angularly and axially adjusted position projecting from an open end of the duct. A shield fixed to the external end of the sleeve backs an annular sealing flange engaged by the damper element, which is enclosed by a flow deflecting hood slidably assembled on the shield.

14 Claims, 6 Drawing Figures

DAMPER MOUNTING ASSEMBLY

BACKGROUND OF THE INVENTION

The invention relates generally to signal controlled dampers for airflow conducting ducts, and embodies certain features disclosed in my prior application, Ser. No. 506,882, filed June 21, 1983, Pat. No. 4,538,980, issued Sept. 3, 1985 with respect to which the present application is a continuation-in-part. Ser. No. 506,882 is a continuation-in-part of Ser. No. 225,729, filed Jan. 15, 1981, Pat. No. 4,426,993, issued Jan. 24, 1984.

According to my aforesaid prior copending application, a damper element is pivotally mounted at the lower end of a duct and its movement between open and closed positions is effected by a signal controlled, power operating unit mounted externally on the duct adjacent the open end. Because of the external mounting of the power operating unit at a fixed location on the duct, the unit may be readily removed or replaced and serviced together with the damper element.

Use of an assembly of such a signal-controlled, power operating unit and damper is believed to be desirable in many installational environments other than that shown in my aforesaid prior copending application. However, different installational settings present problems relating to flow, spatial limitations and other requirements inconsistent with easy access for servicing, maintenance, removal and replacement of the power operating unit and damper assembly.

It is therefore an important object of the present invention to provide a new and useful installational arrangement for the power operating unit and damper assembly as disclosed in my aforesaid prior copending application. In particular, it is an object of the present invention to provide an installational arrangement that is more flexible in application and adjustable without sacrifice of accessibility for servicing and removal.

SUMMARY OF THE INVENTION

In accordance with the present invention, a damper element is pivotally supported in operative relation to a power operating unit enclosed by a housing mounted internally within a duct having an open end from which the damper pivot structure projects. A support for the unit housing provides duct sealing means spaced externally from the open end of the duct for engagement by the damper element in its closed position.

In one particular embodiment of the invention, the unit housing support, in the form of a tubular sleeve, is axially and angularly slidable within the duct with a sliding friction fit to adjustably position the sealing means in axially spaced relation to the open end of the duct. The sealing means is in the form of an annular flange contacted by the damper element when displaced to its closed position from a fully open portion extending at an angle from the sealing flange. The flange is backed by a planar shield fixed to the tubular sleeve onto which a hood is adapted to be slidably assembled in enclosing relation to the damper element. The hood is provided with a screened opening aligned with a plane parallel to the longitudinal axis of the duct. The hood is adjustable angularly and axially relative to the duct by means of the support sleeve.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
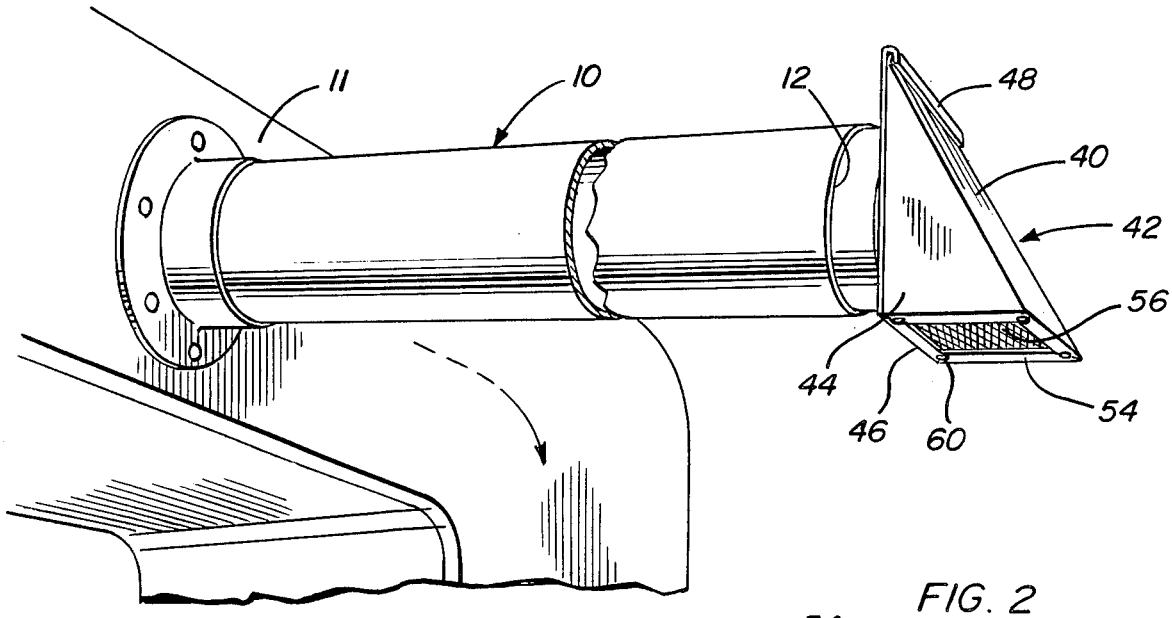
FIG. 1 is a perspective view illustrating a typical installation in accordance with the present invention.
Figure 2:
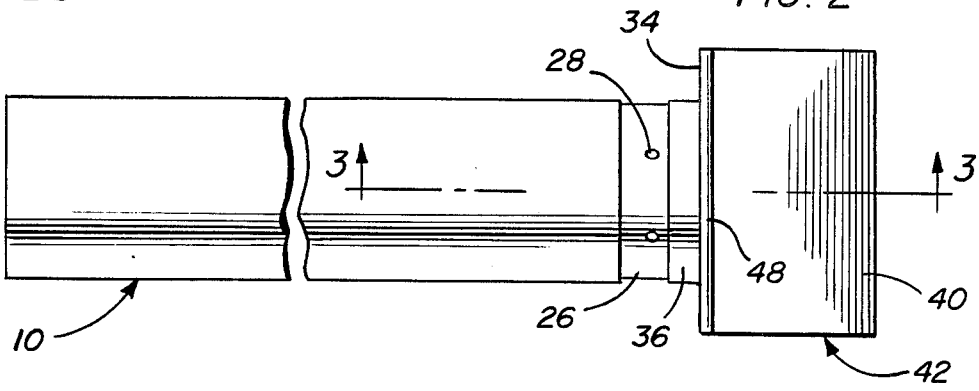
FIG. 2 is a partial top plan view of the installation shown in FIG. 1.
Figure 5:
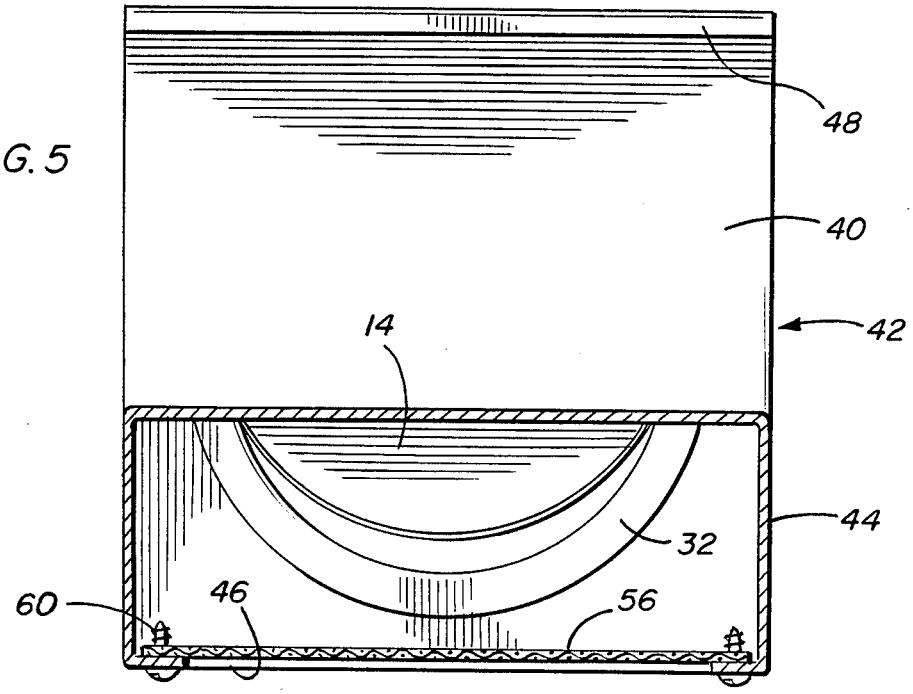
FIG. 5 is a front sectional view taken substantially through a plane indicated by section line 5—5 in FIG. 3.

Referring now to the drawings in detail, an elongated, tubular duct 10 is shown in FIGS. 1–4, adapted to be associated with some air impelling equipment such as a combustion heating system having a return air duct 11. An inflow of air, for example, is adapted to be received through an open end 12 of the duct 10 at a rate controlled through a damper element 14 which is accordingly displaced between a fully open position as more clearly seen in FIG. 3 and a closed position substantially blocking inflow to the duct. The damper element 14 in the illustrated embodiment is in the form of a circular plate operatively connected to a powered damper operating assembly generally denoted by reference numeral 16. The assembly 16 is supported within and enclosed by a tubular housing 18 and is described in detail in my prior copending application, aforementioned. The damper element 14 is thereby displaced in delayed response to signal controlled energization of a motor through a motion transmitting rod 86 pivotally connected to an actuating lever element 58 pivotally suspended from a pivot support member 70 fixed to the assembly housing 18. The lever element 58 has a curved, leaf spring extension 20 projecting from the open end 22 of housing 18, and connected by a pair of rivet fasteners 24 to the damper element in the illustrated embodiment. The damper operating assembly 16 otherwise operates in a manner described in my aforementioned prior copending application whereby movement is imparted to the damper of element and sensed by the feeler element 56 engaging the actuator of the limit switch 52.

Figure 6:
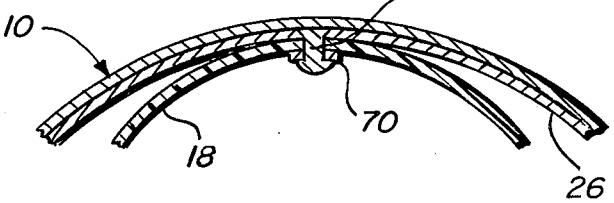
FIG. 6 is a partial sectional view taken substantially through a plane indicated by section line 6—6 in FIG. 3.

In accordance with the present invention, the housing 18 supporting assembly 16 is adjustably positioned both axially and angularly within the duct 10 by means of a tubular supporting sleeve 26 to which the housing 18 is secured by fasteners 28 and by a rivet 30 which also secures the pivot member 70 thereto as more clearly seen in FIG. 6. The tubular sleeve 26 is slidably received with a friction sliding fit within the duct and extends from its open end 12 by an axially adjusted amount to accommodate different installational requirements. An annular sealing flange 32 is formed at the axial end of the tubular sleeve externally of the duct, and is backed by a rectangular shield 34 to which the flange 32 is welded. An axial hub portion 36 of the shield is also welded to the tubular sleeve to form a rigid assembly therewith.

Figure 3:
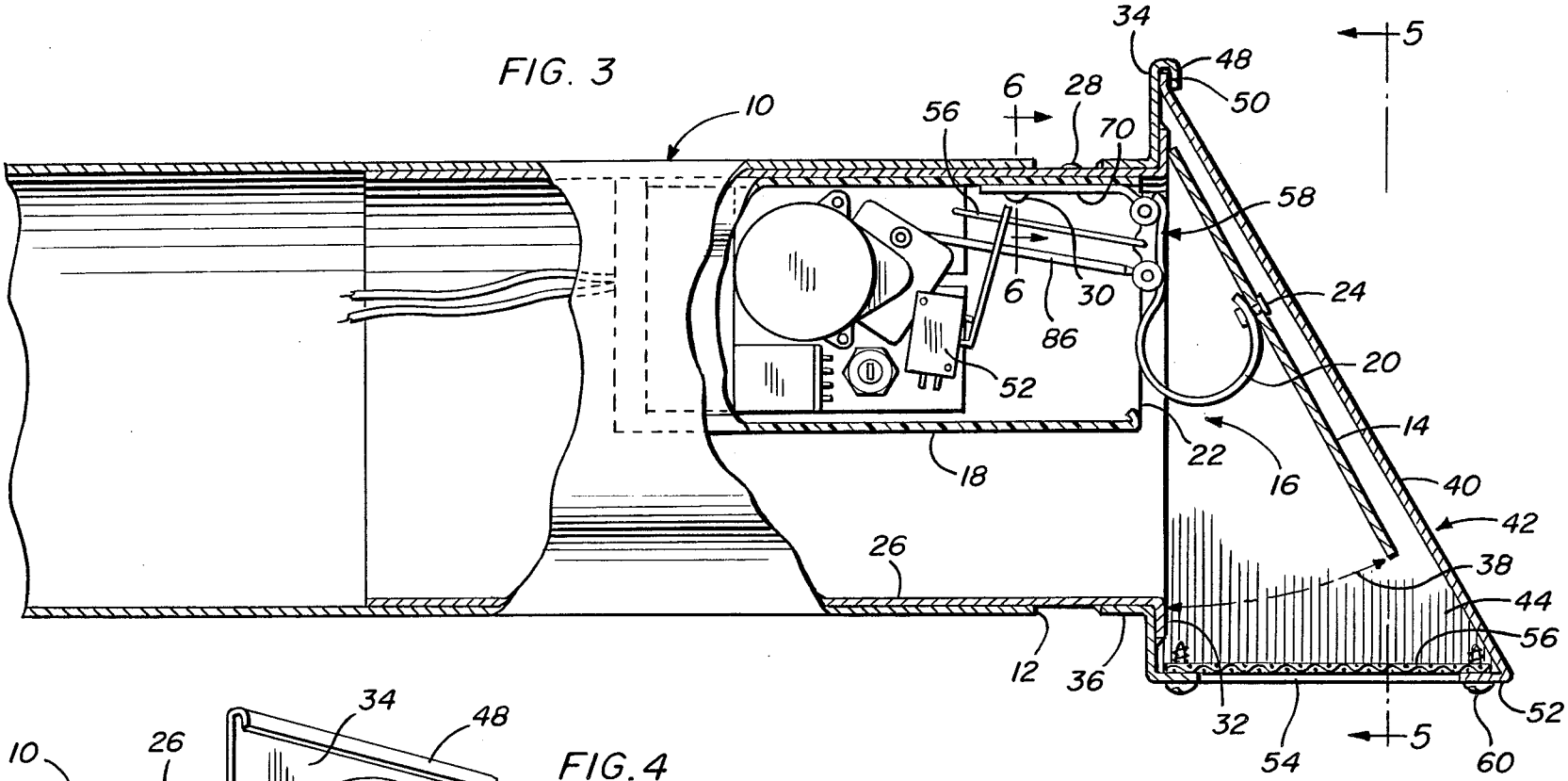
FIG. 3 is an enlarged side sectional view taken substantially through a plane indicated by section line 3—3 in FIG. 2.
Figure 4:
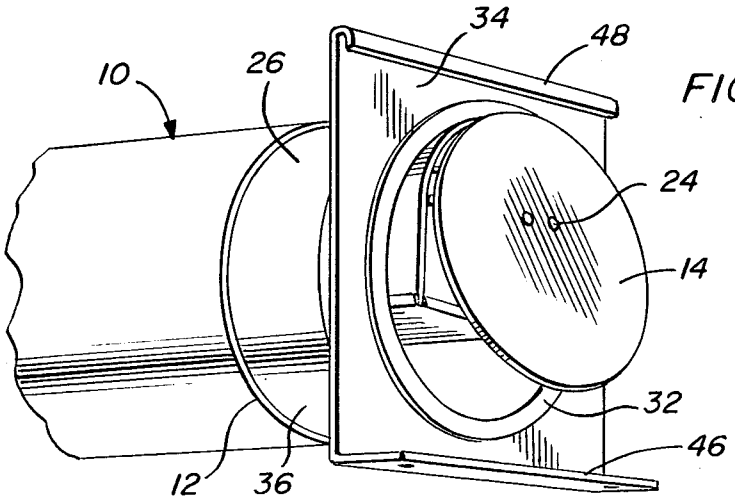
FIG. 4 is a partial perspective view of the installation shown in FIG. 1 with the hood removed.

As more clearly seen in FIGS. 3 and 4, the damper element 14 in its fully open position contacts the annular sealing flange along a very small arcuate portion as it extends at an acute angle 38 to the shield 34. The damper element is retracted to its closed position through lever extension 20 for contact with the annular sealing flange 32 substantially along its entire circular extent.

Movement of the damper element 14 to the fully open position may be limited by engagement with an inclined flow detecting wall 40 of a hood 42 enclosing the damper element. The wall 40 interconnects a pair of right triangular side walls 44 of the hood in parallel spaced relation to each other and in edge abutting relation to the shield 34 between a lower projecting flange 46 and an upper retainer formation 48 slidably receiving an angulated edge portion 50 of the wall 40. Thus, the hood 42 may be slidably assembled laterally onto the shield 34 between lower flange 46 and upper formation 48. An opening is thereby framed by the lower flange 46 on the shield 34, and lower flanges 52 and 54 on the wall 40 and the side walls 44, respectively. The framed opening is in alignment with a plane transverse to end 12 of the duct 10 or parallel to its longitudinal axis and is occupied by a screen 56 secured to flanges 54 by screw fasteners 60. Upon removal of fasteners 60, the hood 42 may be slidably disassembled for servicing of the assembly 16 exposed thereby and/or to clean the hood or screen 56. Further, by slidable and angular adjustment of the tubular sleeve 26 relative to the duct 10, the screened opening of the hood 42 may rreceive a directed inflow of air as desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an elongated duct having an open end, a damper element and an operating unit having pivot means for suspending the damper element and transmitting means operatively connected to the damper element for signal controlled movement thereof from a closed position to an open position, installational means for mounting the operating unit and the damper element on the duct, said installational means comprising a housing protectively enclosing the operating unit, means for supporting the housing within the duct with the pivot means projecting from the housing through the open end of the duct, sealing means connected to the supporting means independently of the pivot means and spaced externally of the duct for engagement by the damper element in the closed position thereof and a hood mounted on the sealing means in enclosing relation to the damper element, said hood having an opening aligned with a plane transverse to the open end of the duct.

2. The combination of claim 1 wherein said supporting means includes a tubular sleeve fastened to the housing of the unit and slidably mounted within the duct, said tubular sleeve projecting axially from the open end of the duct.

3. The combination of claim 2 wherein said sealing means includes an annular flange secured to the tubular sleeve in axially spaced relation to the open end of the duct and a backing shield fixed to the tubular sleeve in abutment with the flange.

4. The combination of claim 3 wherein the transmitting means includes a curved leaf spring element pivotally connected to the pivot means and fastener means securing the leaf spring element to the damper element in spaced relation to the annular flange.

5. The combination of claim 4 wherein the hood includes a pair of triangular side walls, a flow deflecting wall interconnecting the sidewalls in spaced relation to each other and means for holding said sidewalls in engagement with the backing shield with the flow deflecting wall extending from the shield at an angle thereto toward the opening of the hood.

6. The combination of claim 5 wherein the hood further includes a screen secured to the flange and the flow deflecting wall between the sidewalls in the opening of the hood.

7. The combination of claim 1 wherein said sealing means includes an annular flange secured to the supporting means in axially spaced relation to the open end of the duct and a backing shield fixed to the supporting means in abutment with the flange.

8. The combination of claim 7 wherein the hood includes a pair of triangular sidewalls, a flow deflecting wall interconnecting the sidewalls in spaced relation to each other and means for holding said sidewalls in engagement with the backing shield with the flow deflecting wall extending from the shield at an angle thereto toward the opening of the hood.

9. The combination of claim 8 wherein the hood further includes a screen secured to the flange and the flow deflecting wall between the sidewalls in the opening of the hood.

10. In combination with an elongated duct having an open end, a damper element and an operating unit having pivot means for suspending the damper element and transmitting means operatively connected to the damper element for signal controlled movement thereof from a closed position to an open position, installational means for mounting the operating unit and the damper element on the duct, said installational means comprising a housing protectively enclosing the operating unit, means for supporting the housing within the duct with the pivot means projecting from the housing through the open end of the duct and sealing means connected to the supporting means independently of the pivot means and spaced externally of the duct for engagement by the damper element in the closed position thereof, said supporting means including a tubular sleeve fastened to the housing of the unit and slidably mounted within the duct, said tubular sleeve projecting axially from the open end of the duct.

11. The combination of claim 10 wherein said sealing means includes an annular flange secured to the tubular sleeve in axially spaced relation to the open end of the duct and a backing shield fixed to the tubular sleeve in abutment with the flange.

12. The combination of claim 11 wherein the transmitting means includes a curved leaf spring element pivotally connected to the pivot means and fastener means securing the leaf spring element to the damper element in spaced relation to the annular flange.

13. In combination with an elongated duct having an open end, a damper element and an operating unit having pivot means for suspending the damper element and transmitting means operatively connected to the damper element for signal controlled movement thereof from a closed position to an open position, installational means for mounting the operating unit and the damper element on the duct, said installational means comprising a housing protectively enclosing the operating unit, means for supporting the housing within the duct with the pivot means projecting from the housing through the open end of the duct and sealing means connected to the supporting means independently of the pivot means and spaced externally of the duct for engagement by the damper element in the closed position thereof, said sealing means including an annular flange secured to the supporting means in axially spaced relation to the open end of the duct and a backing shield fixed to the supporting means in abutment with the flange.

14. In combination with an elongated duct having an open end, a damper element and an operating unit having pivot means for suspending the damper element and transmitting means operatively connected to the damper element for signal controlled movement thereof from a closed position to an open position, installational means for mounting the operating unit and the damper element on the duct, said installational means comprising a housing protectively enclosing the operating unit, means for supporting the housing within the duct with the pivot means projecting from the housing through the open end of the duct and sealing means connected to the supporting means independently of the pivot means and spaced externally of the duct for engagement by the damper element in the closed position thereof, the transmitting means including a curved leaf spring element pivotally connected to the pivot means and fastener means securing the leaf spring element to the damper element in spaced relation to the supporting means.

* * * * *